US006443683B2

(12) United States Patent
Randak

(10) Patent No.: US 6,443,683 B2
(45) Date of Patent: Sep. 3, 2002

(54) SYSTEM FOR TRANSPORTING VEHICLES USING PALLETS AND TRAINS

(76) Inventor: Frank C. Randak, 8 Fallen Oaks Dr., Thousand Oaks, CA (US) 91360

( * ) Notice: Subject to any disclaimer, the term of this patent is extended or adjusted under 35 U.S.C. 154(b) by 0 days.

(21) Appl. No.: 09/852,816

(22) Filed: May 9, 2001

Related U.S. Application Data

(60) Provisional application No. 60/204,027, filed on May 15, 2000.

(51) Int. Cl.[7] ..... B65G 67/00

(52) U.S. Cl. ..... 414/343; 414/339; 414/353; 414/398

(58) Field of Search ..... 198/370.06; 414/257, 414/339, 343, 351, 353, 398, 528

(56) References Cited

U.S. PATENT DOCUMENTS 2,691,450 A * 10/1954 Rosenbaum ..... 414/343
3,416,684 A * 12/1968 Barry ..... 414/343
4,093,084 A * 6/1978 Ringer ..... 414/343
5,676,514 A * 10/1997 Higman et al. ..... 414/339
6,209,703 B1 * 4/2001 Soldavini ..... 198/370.06

* cited by examiner

*Primary Examiner*—Joseph E. Valenza
(74) *Attorney, Agent, or Firm*—Robert R. Lawrence

(57) ABSTRACT

An improved system for transporting vehicles and passengers from one destination to another using pallets, trains and guideways. The automobile uses ramp 1 to enter station 2 and park in port 3. The port then rotates 45 degrees 4 and parallel to a pallet guideway 5. The system then moves the pallet 6 along the pallet guideway next to a port 7 and parks. A mechanism on the pallet transfers the vehicle from the port 7 to the pallet 6. The pallet accelerates on a pallet guideway 8 and moves next to a train 9 that is traveling in the same direction on a train guideway 10. The pallet docks with an empty slot 11 on said train while both are moving. The pallet moves the automobile onto said train and undocks. The empty pallet continues along the pallet guideway 12 back to the station to pick up another vehicle. As said train approaches the next station, an empty pallet docks with the train at the said slot that contains the automobile. The pallet transfers the automobile from the train to the pallet. The mechanism on the pallet transfers the vehicle from the pallet to the empty port 13. The AVT-Port then rotates 45 degrees and the automobile exits by way of ramp 14.

1 Claim, 6 Drawing Sheets

SYSTEM FOR TRANSPORTING VEHICLES USING PALLETS AND TRAINS

CROSS REFERENCE TO RELATED APPLICATIONS

This application claims the benefit of Provisional Patent Application Serial No. 60/204,027 filed on May 15, 2000.

STATEMENT REGARDING FEDERALLY SPONSORED RESEARCH OR DEVELOPMENT (NOT APPLICABLE)

BACKGROUND OF THE INVENTION

1. Field of Invention

This invention relates to transportation systems, specifically to an improved system for transporting vehicles and passengers from one destination to another using pallets, trains and guideways.

2. Description of Relevant Prior Art

Many travelers wish to travel from one destination to another with their automobiles but without driving. Existing conventional mass transportation systems are not attractive alternatives to those travelers who wish to have their automobiles at their disposal at their destination. Shortcomings in these existing systems render them unsatisfactory and unsuitable for this purpose. A need therefore exists for an effective mass transportation system that transports vehicles and their passengers from one destination to another.

The present invention's technology allows travelers to travel swiftly, smoothly and safely to their destinations while never leaving their vehicles in much less time than conventional driving. The invention uses a unique design system that moves automobiles from pallets onto trains without the use of switches and then transports the automobiles and their passengers on guideways at a rate of approximately 80 miles per hour. The trains consist of air-conditioned compartments that have restrooms, entertainment centers and vending machines, which allows for a comfortable, quick transport from one destination to another. Because the trains travel on guideways that are similar to train tracks, the present invention could utilize tracks of existing rail systems such as the Blue Line in Los Angeles or BART in San Francisco. The invention is entirely electric and, as such, is safer on the environment. Its use would result in reduced vehicle emissions and gasoline usage.

The present invention offers significant advantages over the relevant prior art. Although several systems may be classified as "dual mode" transportation systems (i.e. they transport vehicles such as automobiles automatically on private guideways), each of these systems contains disadvantages and drawbacks that must be addressed to provide an effective and workable security transportation system. In general, the current relevant art relies on switches to add and remove the automobiles to and from the system. Furthermore, none of these systems transport the automobiles by trains.

A number of U.S. patents and other prior art provide for transportation systems but lack certain features and advantages of the present invention. The most comprehensive list of dual mode systems in on the following web site: http://faculty.washington.edu/jbs/itrans. Six of these dual mode systems transport vehicles on guideways: (1) the Autoshuttle from Germany; (2) the AUTRAN from Austria (U.S. Pat. Nos. 5,590,603, 5,590,604, 5,598,783, 5,706,735, 5,979,334, and 6,082,268); (3) the FlexiTrain from New Zealand; (4) the MegaRail from Texas (U.S. Pat. No. 6,039,135); (5) the Palleted Automated Transportation from MIT; and (6) the RUF System from Denmark.

All of these systems transport conventional automobiles on elevated guideways. The FlexiTrain and the RUF systems require specially built cars. Although the present invention also transports conventional vehicles automatically on private guideways, it is different in two significant ways: First, the present invention uses pallets to load and unload the automobiles onto and from a moving train. None of the other systems transfers the automobiles onto a train. Second, the present invention eliminates the need for switches when adding and removing automobiles to and from the system. All of the other systems use some type of "Y" switch that is inherently unreliable at high speeds.

Furthermore, transporting automobiles on trains makes it possible for the present invention to offer many attractive services to the travelers: (1) Television to communicate with the riders, project the view from the front and rear of the train and provide entertainment; (2) private restroom facilities; (3) refreshments in vending machines; (4) complete privacy and anonymity; (5) first class accommodations such as an adjacent suite with furniture and business office equipment and teleconferencing equipment; (6) a quiet ride because of the private train compartment, welded steel tracks and separation of the guideway from highway noise; and (7) higher potential speed and resulting reduced travel times than vehicles that are traveling individually on pallets on guideways.

The present invention has the additional advantage of operating at very high speeds to enable inter continental travel using pressurized trains that travel in partially evacuated tubes, incorporating air cushion technology.

BRIEF SUMMARY OF THE INVENTION

The main embodiment of the present invention comprises an improved mass transportation system for transporting vehicles and passengers from one location to another. The major components of the system include pallets, guideways, trains, ramps, stations, ports, and slots. The present invention's technology allows travelers to travel swiftly, smoothly and safely to their destinations while never leaving their vehicles in much less time than conventional driving. The invention uses a unique design system that moves automobiles from pallets onto trains without the use of switches and then transports the automobiles and their passengers on guideways at a rate of approximately 80 miles per hour.

According to another embodiment, the present invention could be used to transport freight in addition to vehicles and passengers.

Objects and Advantages

Accordingly, an object and advantage of the present invention is to provide an improved mass transportation system for transporting vehicles and passengers from one location to another. Further objects and advantages of the invention are to provide a mass transportation system (a)

that operates on electricity and results in reduced vehicle emissions and reduced gasoline consumption; and (b) that provides an alternative to highway driving and results in reduced traffic congestion.

The invention is an improvement over the prior art and addresses a defined need in the marketplace. Unlike the prior art, the present invention transfers the automobiles and their passengers from pallets onto trains while the trains are moving. Furthermore, unlike the prior art, the invention operates without the need for switches.

Still further objects and advantages will become apparent from a consideration of the ensuing description and accompanying drawings.

BRIEF DESCRIPTION OF THE SEVERAL VIEWS OF THE DRAWING

Drawing Figures

REFERENCE NUMERALS IN DRAWINGS

1 Entry Ramp
2 Entry Station
3AVT-Port at Station
4 AVT-Port ready for docking
5 Pallet Guideway
6 AVT-Pallet
7 AVT-Port on Guideway
8 Pallet Guideway
9 AVT-Train
10 Train Guideway
11 AVT-Slot on an AVT-Train
12 AVT-Pallet returning to Entry Station
13 AVT-Port in Exit Station
14 Exit Ramp
15 AVT-Port Conveyor Belt
16 AVT-Pallet Conveyor Belt
17 Adjustable Wheel Chock
18 Free Turning Wheel Chock Rollers
19 Emergency Vehicle Stop
20 AVT-Slot Conveyor Belt
21 -
22 -
23 AVT-Pallet moving at same speed of AVT-Train next to an empty AVT-Slot
24 Docking Holes
25 -
26 -
AVT-Pallet moving next to AVT-Slot on AVT-Train at Exit Station
28 Train Yard
29 Freight Train
30 Train Guideways
31 Exit Stations
32 Northbound Train Guideway
33 Southbound Train Guideway
34 Eastbound Train Guideway
35 Westbound Train Guideway
36 AVT-Pallet Guideways
37 Docking Rod

DETAILED DESCRIPTION OF THE INVENTION

Description—Main Embodiment

Figure 1:
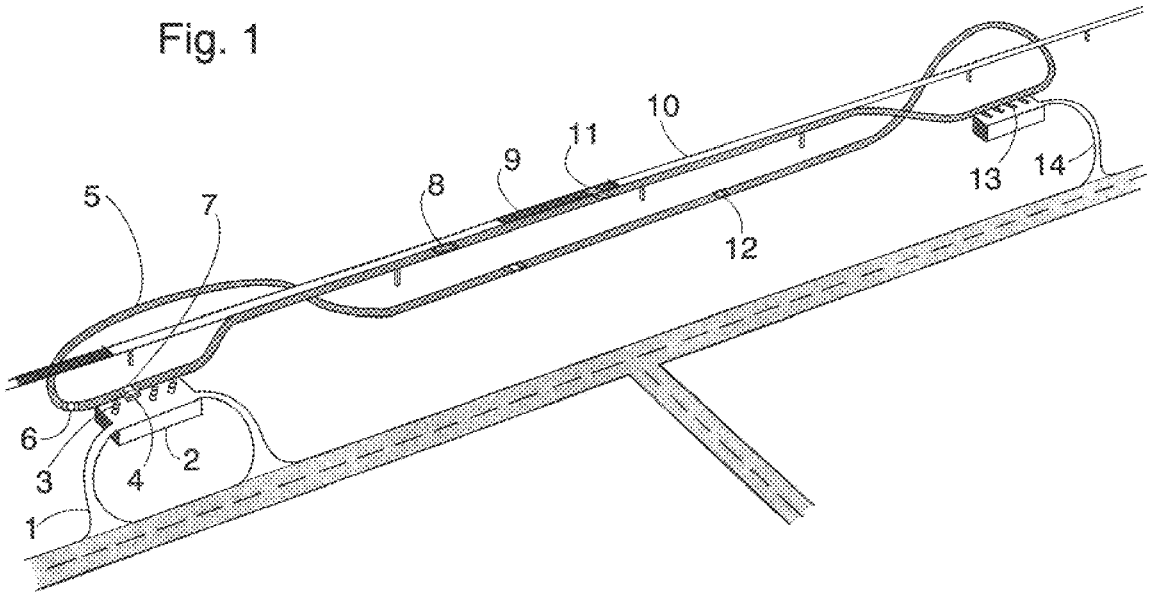
FIG. 1 is an overall view of the system for transporting vehicles from one destination to another using pallets ("AVT-Pallets"), trains ("AVT-Trains") and guideways ("Guideways").

FIG. 1 depicts the major components of a system that transports vehicles and passengers from one destination to another on elevated guideways. The entire system is electric and controlled by a network of computers. The major components of the system include Entry and Exit Ramps, Entry and Exit Stations, AVT-Ports, AVT-Pallets, AVT-Slots, Pallet Guideways, Train Guideways, and AVT-Trains.

The driver of the vehicle uses an Entry Ramp 1 to drive into an Entry Station 2 and park in an AVT-Port 3. After the vehicle is parked in the AVT-Port, the driver selects a destination using a mobile phone. The AVT-Port then rotates 45 degrees 4 and parallel to a Pallet Guideway 5. The system then moves the AVT-Pallet 6 along the Pallet Guideway next to an AVT-Port 7 and parks. A mechanism on the AVT-Pallet (See FIG. 3) transfers the vehicle from the AVT-Port to the AVT-Pallet.

The AVT-Pallet accelerates onto a Pallet Guideway 8 and moves next to an AVT-Train 9 that is traveling in the same direction on a Train Guideway 10. The AVT-Pallet docks with an empty AVT-Slot 11 on an AVT-Train while both are moving. The AVT-Pallet moves the vehicle onto the AVT-Train and undocks. The AVT-Pallet continues 12, without a vehicle, back to the Entry Station to pick up another vehicle.

When a vehicle approaches an Exit Station, an empty AVT-Pallet docks with an AVT-Train at the AVT-Slot that contains the vehicle. The AVT-Pallet moves the vehicle from the AVT-Slot to the AVT-Pallet and parks next to an empty AVT-Port 13 in the Exit Station. The mechanism on the AVT-Pallet transfers the vehicle from the AVT-Pallet to the AVT-Port. The AVT-Port then rotates 45 degrees and the driver drives the vehicle out using Exit Ramp 14.

Stations operate as both Entry Stations and Exit Stations providing failsafe capabilities by means of re-circulating AVT-Pallets.

AVT-Trains travel at high speeds between cities and slower speeds within the vicinity of the Stations.

Figure 2:
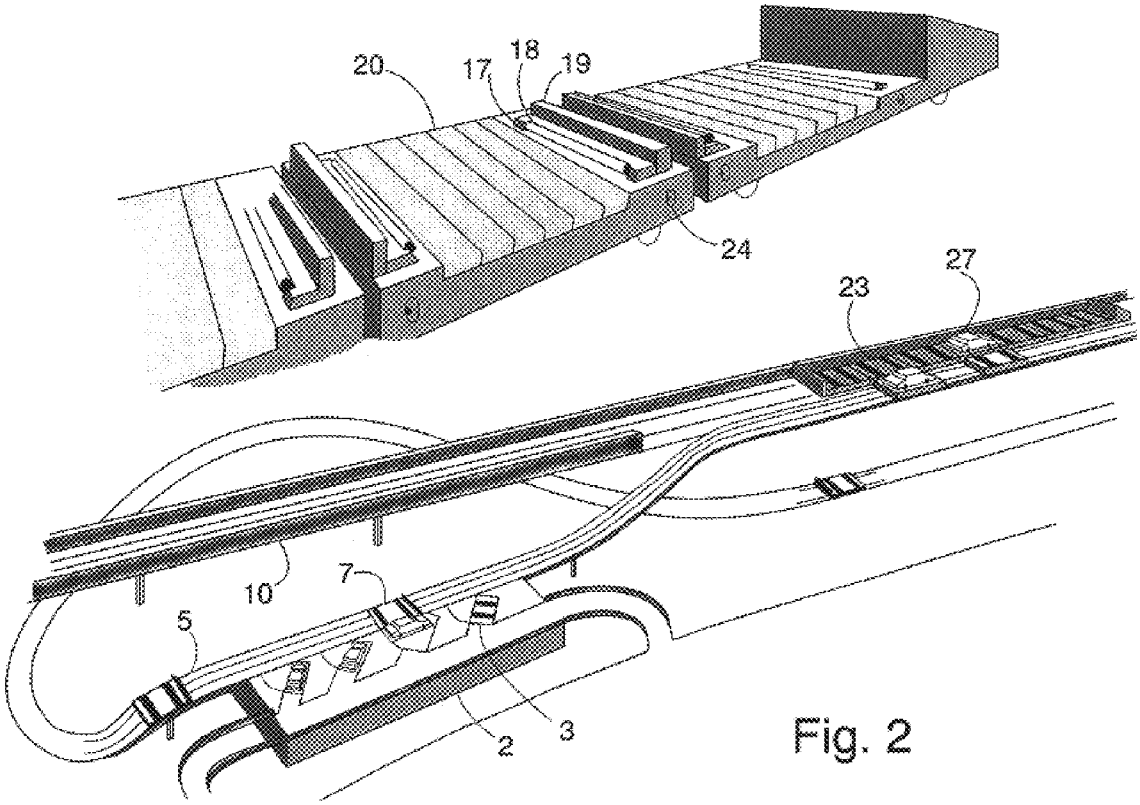
FIG. 2 is a detailed view of an Entry Station, Vehicle Port ("AVT-Port"), Pallet Guideway, Train Guideway and AVT-Train.
Figure 3:
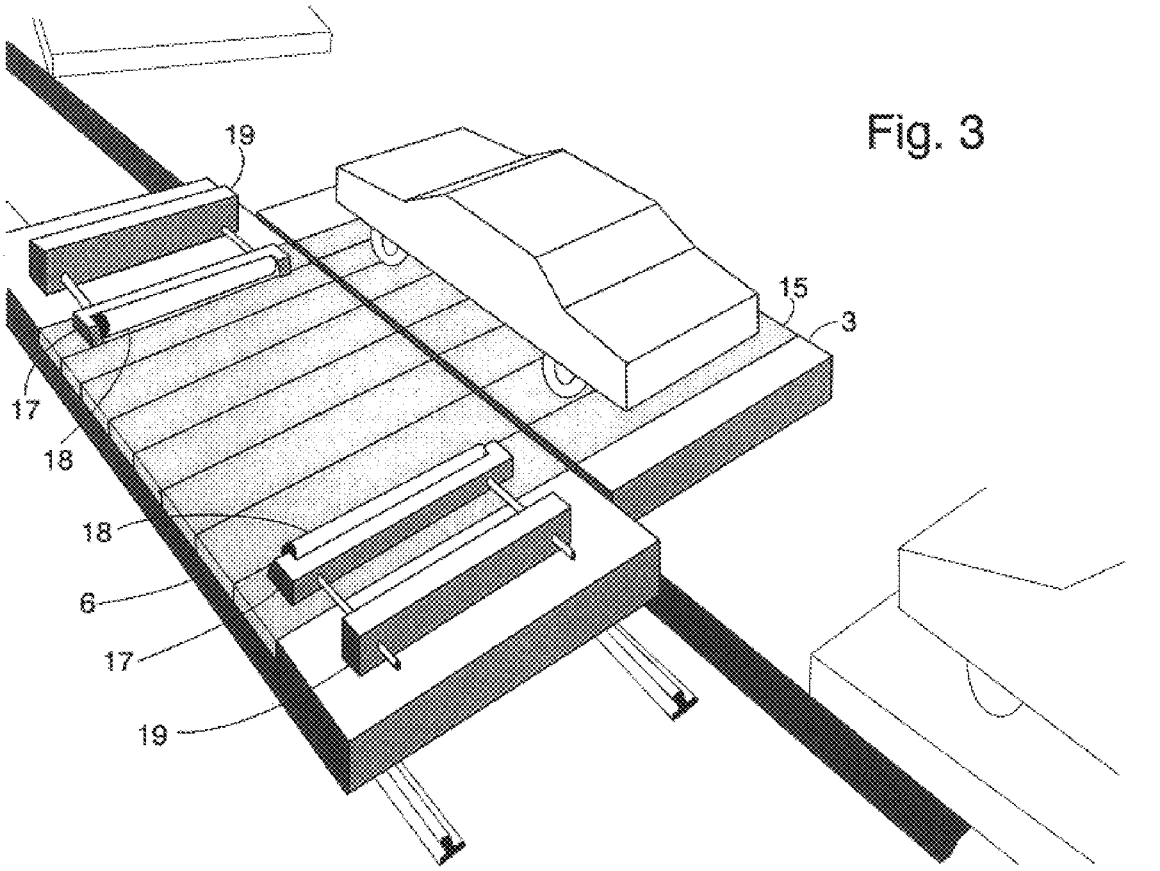
FIG. 3 is a detailed view of an AVT-Pallet, which moves a vehicle from an Entry Station onto an AVT-Train.
Figure 4:
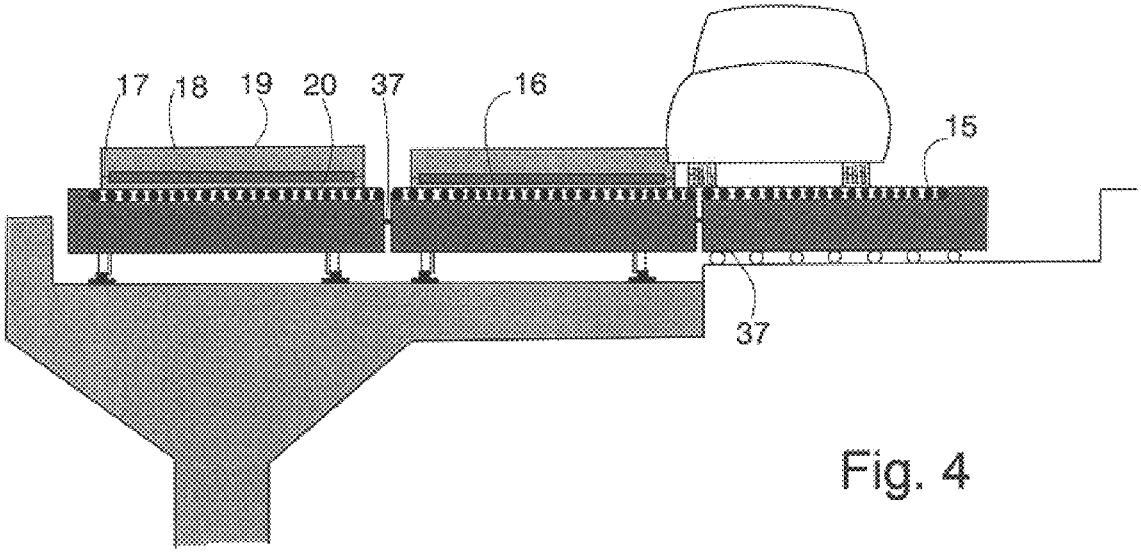
FIG. 4 is a detailed view of the mechanism on the AVT-Pallet that lifts and moves the vehicle from the AVT-Port to the AVT-Pallet.

FIGS. 2 through 4 shows the details of an AVT-Pallet and an AVT-Train that are involved in moving the vehicles.

Operation—Main Embodiment

FIG. 2 shows an Entry Station 2 with four AVT-Ports 3. Entry and Exit Stations likely have many more AVT-Ports. Public vans would be available to transport those without vehicles on the system. The driver parks in an empty AVT-Port and requests a destination using a mobile phone and a password. If the request is accepted, the AVT-Port locks the vehicle in place on pads of rollers on which the vehicle sits. Once the vehicle is secure, the AVT-Port rotates 45 degrees 7 and waits for an AVT-Pallet.

AVT-Pallets travel on Pallet Guideways 5 and AVT-Trains travel on Train Guideways 10. AVT-Pallets never travel on Train Guideways. Rather, they circulate between Entry Stations and Exit Stations on AVT-Pallet Guideways.

An AVT-Pallet docks with an AVT-Port 7 before the vehicle is moved from the AVT-Port to the AVT-Pallet. Docking Rods 37 are extended from within the AVT-Pallet and inserted into Docking Holes in the AVT-Port 24. This connection secures the alignment of the AVT-Pallet with the AVT-Port and provides a method of transferring information about the vehicle to the AVT-Pallet.

FIG. 3 shows an AVT-Pallet 6 that is docked with an AVT-Port 3 on which a vehicle is parked. Most of the top surface of the AVT-Port is covered with 24-inch wide conveyor belts 15 on which the vehicles are parked. The top surface of the AVT-Pallet is also covered with 24-inch wide conveyor belts 16. Vehicles are moved from the AVT-Ports to the AVT-Pallets by the 2 sets of conveyor belts. The Vehicles are secured on the AVT-Pallets with Adjustable Wheel Chocks 17 that have free turning rollers 18. The rollers resist the vehicle from driving over the wheel chocks if the vehicle is started by mistake while on the AVT-Pallet. Emergency Vehicle Stops 19 prevent the vehicle from leaving the pallet in case the wheel chocks are ineffective, e.g. for 4-wheel drive vehicles.

FIG. 2 depicts the transfer of a vehicle from an AVT-Pallet and onto an AVT-Train. At the appropriate time, a computer in the Entry Station 2 sends a command to a computer in the AVT-Pallet 7 to transfer the vehicle from the AVT-Pallet to an AVT-Slot on an approaching AVT-Train. The on-board computer commands the AVT-Pallet to accelerate so it is traveling at the same speed of the AVT-Train next to an empty AVT-Slot 23. When the AVT-Pallet is aligned with the empty AVT-Slot, the AVT-Pallet extends two Docking Rods into Docking Holes 24 in the AVT-Slot. The vehicle is moved to the AVT-Train conveyor belts on the AVT-Pallet and the AVT-Slot 20. The AVT-Pallet then undocks from the AVT-Slot and is free to unload a vehicle from the same train or to proceed back to the Entry Station.

FIG. 2 shows an AVT-Train which the same type of Adjustable Wheel Chocks 17 and Emergency Vehicle Stops 19. Typically, an AVT-Trains contains 10 to 20 AVT-Slots.

Vehicles may idle while traveling on the AVT-Train in order to supply power for air conditioning and other electric devices. The AVT-Train has airfoils that direct airflow into the radiators of the vehicles to prevent overheating.

FIG. 2 also depicts the components that move the vehicle from an AVT-Train to an Exit Station. As a vehicle approaches its destination Exit Station, an AVT-Pallet moves next to its AVT-Slot on the AVT-Train 27, docks with the AVT-Slot, lifts the vehicle off the AVT-Slot and moves it to the AVT-Pallet. The AVT-Pallet undocks and proceeds to the Exit Station where it parks next to an empty AVT-Port. The AVT-Pallet docks with the AVT-Port, moves the vehicle onto the AVT-Port, lowers the vehicle onto the AVT-Port, undocks from AVT-Port and proceeds to the Entry Station. The AVT-Port rotates 45 degrees after the AVT-Pallet undocks and the vehicle is driven out of an Exit Station.

Figure 5:
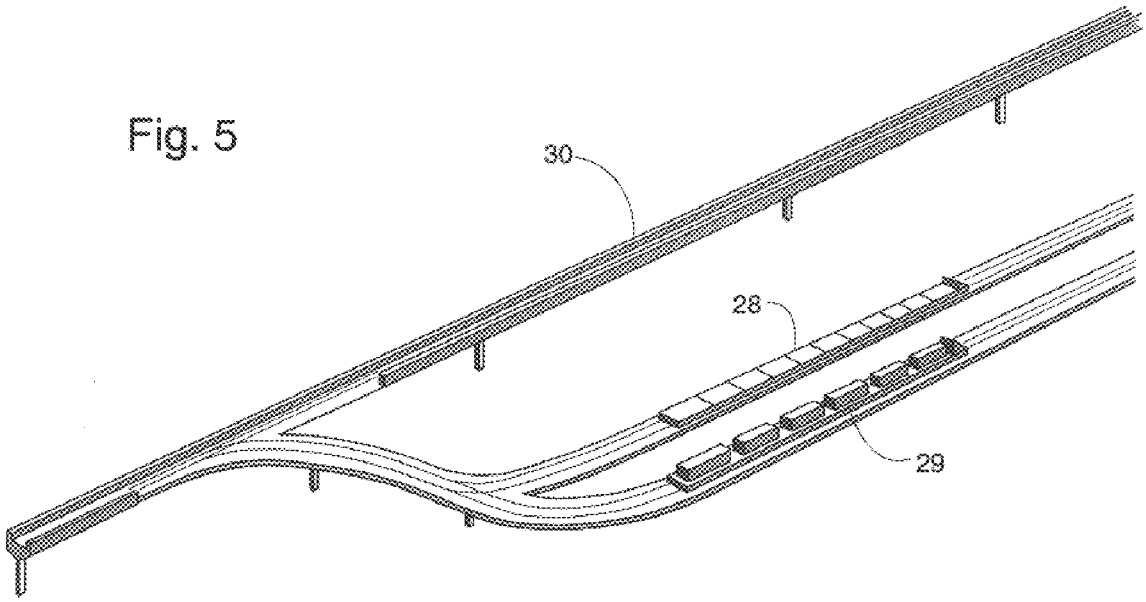
FIG. 5 is a view of a yard where AVT-Trains are stored and maintenance is performed.

FIG. 5 shows part of a Train Yard that contains one AVT-Train 28 and one Freight Train 29 ("F-Train"). Train Guideways 30 carry both AVT-Trains and F-Trains at the same time but F-Trains are only loaded and unloaded in Train Yards. Train Yards are also used to store AVT-Trains that are not needed during light traffic periods. Train Yards are also used to repair AVT-Trains and handle emergencies in case of a malfunction.

Figure 6:
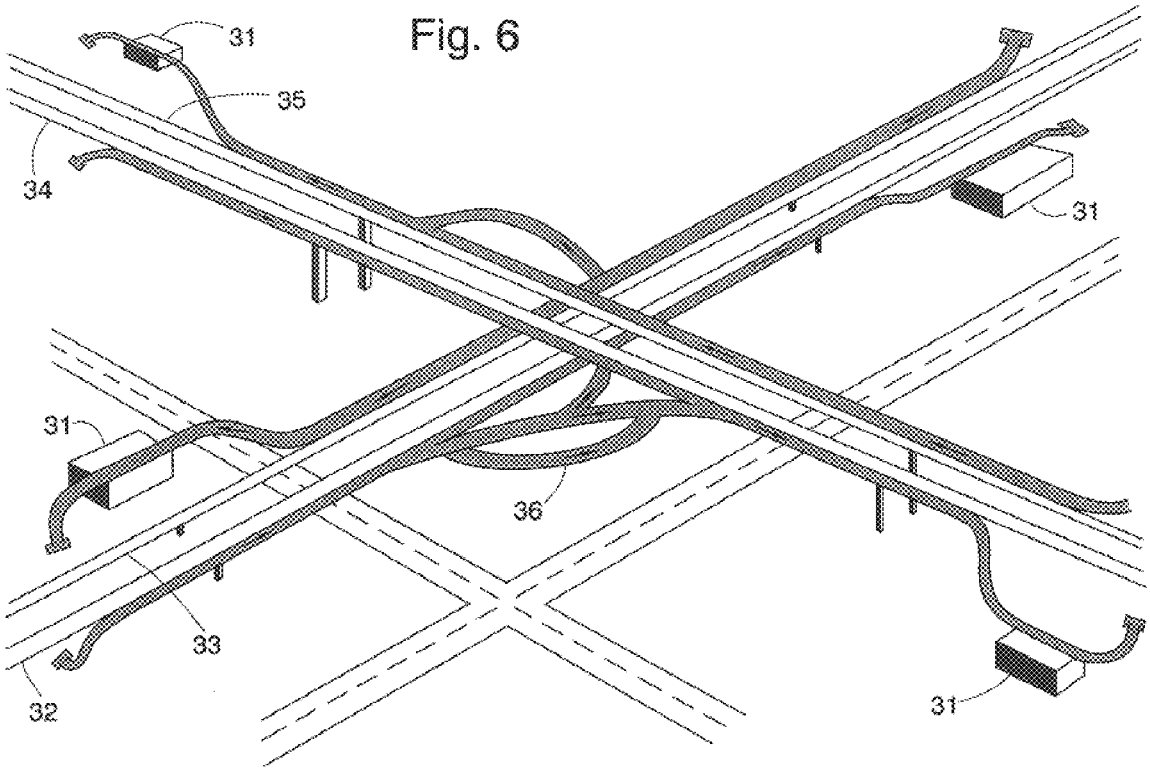
FIG. 6 depicts an interchange of four Train Guideways: northbound, southbound, eastbound and westbound.

FIG. 6 illustrates the complexity of an interchange of four Train Guideways: North 32, South 33, East 34 and West 35. Only the AVT-Pallet Guideways for the northbound traffic are shown 36. Four Exit Stations 31 are provided as emergency exits. AVT-Pallets are shown circulating within the interchange through underground tunnels.

Description and Operation—Alternative Embodiments

The use of AVT-Pallets makes it possible to retrofit existing rail systems to accommodate AVT-Trains. For example, the Bart System in San Francisco, Calif. could also carry AVT-Trains along with regular passenger trains. Magnetic Levitation (Mag-Lev) could be used for the AVT-Trains. However, the AVT-Train switches would be more complex and much more expensive.

In addition, the train cars could be compartments with doors instead of flat bed cars. Compartments allow the trains to have restrooms, entertainment, refreshments and other features provided by conventional trains like AMTRAK.

Furthermore, the speed of the present invention could be increased to over 1000 MPH by using pressurized compartments, air locks, an enclosed and partially evacuated guideway tube and air cushion suspension for speeds over 250 MPH Conclusion, Ramifications, and Scope Thus, the reader can see that a mass transportation system that transports vehicles and passengers from one destination to another can be built using existing technology. This system would enable individuals to travel with their automobiles from one destination to another without driving. In addition, its use would reduce vehicle emissions and ease traffic congestion.

Although the description above contains many specificities, these should not be construed as limiting the scope of the invention but as merely providing illustrations of some of the presently preferred embodiments of this invention. Other embodiments and ramifications of the invention are possible as well. For example, the invention may be used to transport freight from one destination to another.

Therefore, the scope of the invention should be determined by the appended claims and their legal equivalents, rather than by the examples given.

What is claimed is:

1. An electrically powered transportation system, comprising:

a. A plurality of entry and exit ramps, each said ramp providing the means of ingress and egress of conventional automobiles into the system;

b. A plurality of entry and exit stations, each said station comprising said ramps, a plurality of ports, pallets and guideways;

c. A plurality of said ports within said stations, each said port having the capacity and ability to stabilize conventional automobiles and rotate said automobiles 45 degrees and parallel to said guideways;

d. A plurality of said pallets within said stations, each said pallet having the capacity and ability to stabilize conventional automobiles, a mechanism to retrieve said automobiles from said ports, a means of moving on said guideways parallel to guideways containing moving trains, and a mechanism to transfer the automobiles from said moving pallets to said moving trains;

e. A plurality of guideways within said stations on which said pallets would move;

f. A plurality of trains, each said train having the capacity to receive conventional automobiles from said pallets, to stabilize and carry said automobiles at high speeds, and to travel on elevated guideways;

g. A plurality of elevated guideways on which said trains would move.

* * * * *